US009869228B2

(12) United States Patent
Achiwa et al.

(10) Patent No.: US 9,869,228 B2
(45) Date of Patent: Jan. 16, 2018

(54) EXHAUST PASSAGE STRUCTURE OF OUTBOARD MOTOR

(71) Applicant: SUZUKI MOTOR CORPORATION, Hamamatsu-Shi, Shizuoka-Ken (JP)

(72) Inventors: Tetsushi Achiwa, Hamamatsu (JP); Keisuke Daikoku, Hamamatsu (JP)

(73) Assignee: SUZUKI MOTOR CORPORATION (JP)

( * ) Notice: Subject to any disclaimer, the term of this patent is extended or adjusted under 35 U.S.C. 154(b) by 0 days.

(21) Appl. No.: 14/978,349

(22) Filed: Dec. 22, 2015

(65) Prior Publication Data

US 2016/0222862 A1 Aug. 4, 2016

(30) Foreign Application Priority Data

Jan. 30, 2015 (JP) ..... 2015-017106

(51) Int. Cl.

| | |
|---|---|
| ***F01N 1/00*** | (2006.01) |
| ***F01N 13/00*** | (2010.01) |
| ***F01N 13/08*** | (2010.01) |
| ***F01N 13/10*** | (2010.01) |
| ***F01N 13/18*** | (2010.01) |

(52) U.S. Cl.

CPC ..... *F01N 13/004* (2013.01); *F01N 13/08* (2013.01); *F01N 13/10* (2013.01); *F01N 13/1805* (2013.01)

(58) Field of Classification Search

CPC ..... F01N 13/004; F01N 13/08; F01N 13/10; F01N 13/1805

See application file for complete search history.

(56) References Cited

U.S. PATENT DOCUMENTS

| | | | | |
|---|---|---|---|---|
| 5,829,249 | A * | 11/1998 | VanRens | F01N 3/24 60/298 |
| 7,788,913 | B2 * | 9/2010 | Midgley | F01N 3/2853 60/273 |
| 8,366,501 | B2 * | 2/2013 | Kazuta | B63H 21/32 440/89 H |
| 9,062,587 | B2 * | 6/2015 | Nakayama | F01N 13/00 |
| 9,745,037 | B2 * | 8/2017 | Nakayama | B63H 20/24 |

FOREIGN PATENT DOCUMENTS

| | | |
|---|---|---|
| JP | 2010-242744 A | 10/2010 |
| JP | 2013-124594 A | 6/2013 |

* cited by examiner

*Primary Examiner* — Mark Laurenzi
*Assistant Examiner* — Jason Sheppard
(74) *Attorney, Agent, or Firm* — Barnes & Thornburg LLP

(57) ABSTRACT

In an exhaust passage structure in a V-type four-stroke engine of an outboard motor, an exhaust passage is connected to the respective exhaust ports of a plurality of cylinders so that a first exhaust passage portion is provided on at least one lateral side of the cylinder block in a width direction and collects exhaust gas discharged from the respective exhaust ports of the plurality of cylinder assemblies, while a second exhaust passage portion connects the first exhaust passage portion with an exhaust muffler chamber installed outside the engine, and an exhaust guiding portion is provided so as to oppose to a joint surface between the cylinder block and the cylinder head in a manner to be located in the first exhaust passage portion to guide the exhaust gas discharged from the exhaust ports to a connecting portion between the first exhaust passage portion and the second exhaust passage portion.

3 Claims, 6 Drawing Sheets

EXHAUST PASSAGE STRUCTURE OF OUTBOARD MOTOR

CROSS REFERENCE TO RELATED APPLICATION

This application is based upon and claims the benefit of priority of the prior Japanese Patent Application No. 2015-017106, filed Jan. 30, 2015, the entire contents of which are incorporated herein by reference.

BACKGROUND OF THE INVENTION

Field of the Invention

The present invention relates to an exhaust passage structure of an outboard motor, in a multi-cylinder four-stroke-cycle engine mounted in the outboard motor, in which exhaust gas from exhaust ports of respective cylinder is discharged out of the engine.

Related Art

Prior art of an outboard motor of conventional art has provided an exhaust device, in which exhaust gases discharged from the exhaust ports of the respective cylinders of a multi-cylinder four-stroke-cycle engine mounted on an outboard motor are collected in an exhaust (gas) collecting portion (i.e., exhaust manifold) and then discharged out of the engine through catalyst portion, for example, see Japanese Patent Laid-open No. 2010-242744 and No. 2013-124594 (Patent Documents 1 and 2). In each of such documents, the exhaust collecting portion is formed to a cylinder head.

In the Patent Documents 1 and 2, as described above, the exhaust collecting portion for collecting exhaust (gas) discharged from the exhaust ports of the cylinder head is mounted to the cylinder head, and moreover, the exhaust collecting portion is formed with a guide surface parallel to a plane surface which passes cylinder axes of a plurality of cylinders formed to a cylinder block. According to such structure, the exhaust gas from the exhaust port collides with the guide surface of the exhaust collecting portion and flow direction of the exhaust gas is rapidly changed from a transverse direction to a perpendicular direction, which results in increasing in flow resistance of the exhaust gas, and hence, output of the engine is lowered.

In addition, in order to lower pressure of the exhaust gas colliding with the guide surface of the exhaust collecting portion formed to the cylinder head, it is necessary to separate the guide surface apart from the exhaust port. However, in such separate arrangement, the cylinder head projects outside in a width direction of the engine. As a result, the size or dimension of the engine is inevitably enlarged, and in a case where a plurality of outboard motors are mounted to a hull of a boat or like, a distance between the adjacently mounted outboard motors increases, which may apply adverse effect on operation or steering performance of the hull of the boat.

SUMMARY OF THE INVENTION

The present invention was conceived in consideration of the circumstances of the prior art mentioned above, and an object thereof is to provide an exhaust passage structure of an outboard motor for the purpose of preventing lowering of output of an engine and making small the engine in size by controlling width dimension of the engine.

The above and other object can be achieved according to an embodiment of the present invention by providing an exhaust passage structure for an outboard motor equipped with a four-stroke engine, in which the four-stroke engine includes: a cylinder block in which a cylinder is formed so as to extend in a horizontal direction; a cylinder head fixed to the cylinder block so as to cover the cylinder and to form a combustion chamber in conjunction with the cylinder, the cylinder head being provided with an exhaust port communicated with the combustion chamber to discharge exhaust gas; and a crankcase which houses a crankshaft extending in a vertical direction, wherein a plurality of cylinder assemblies each equipped with the cylinder, the combustion chamber, and the exhaust port are arranged side by side in the vertical direction in the cylinder block and under the cylinder head;

an exhaust passage connected to the respective exhaust ports of the plurality of cylinders so as to lead the exhaust gas out of the engine includes a first exhaust passage portion and a second exhaust passage portion, in which the first exhaust passage portion is provided on at least one lateral side of the cylinder block in a width direction and configured to collect the exhaust gas discharged from the respective exhaust ports of the plurality of cylinder assemblies, while the second exhaust passage portion connects the first exhaust passage portion with an exhaust muffler chamber installed outside the engine; and an exhaust guiding portion is provided so as to oppose to a joint surface between the cylinder block and the cylinder head in a manner to be located in the first exhaust passage portion to guide the exhaust gas discharged from the exhaust ports to a connecting portion between the first exhaust passage portion and the second exhaust passage portion.

According to the preferred embodiment of the present invention described above, since the first exhaust passage portion for collecting and gathering together the exhaust gas from a plurality of exhaust ports, the exhaust ports provided in the cylinder head can be increased in length. Furthermore, since the exhaust guiding portion of the first exhaust passage portion guides the exhaust gas from the exhaust ports to the connecting portions to the second exhaust passage portion, the flow resistance against the exhaust gas flowing from the exhaust ports 36 through the first exhaust passage portion to the second exhaust passage portion can be reduced, making it possible to prevent power loss of the engine.

In addition, since the first exhaust passage portion is formed to the cylinder block by connecting the first exhaust passage portion collecting the exhaust gas to the exhaust ports formed to the cylinder head, the existence of the first exhaust passage portion can eliminate necessity for increasing in the dimension in the width direction, thus downsizing the engine.

The nature and the further characteristic features of the present invention will be made clearer from the following description made with reference to the accompanying drawings.

DESCRIPTION OF THE PREFERRED EMBODIMENT

An embodiment of the present invention will be described hereunder with reference to the accompanying drawings. It is to be noted that, in the following descriptions, terms "upper", "lower", "right", "left" and the like terms indicating directions are used with reference to the illustrated state of the drawings or a state mounted to a hull.

Figure 1:
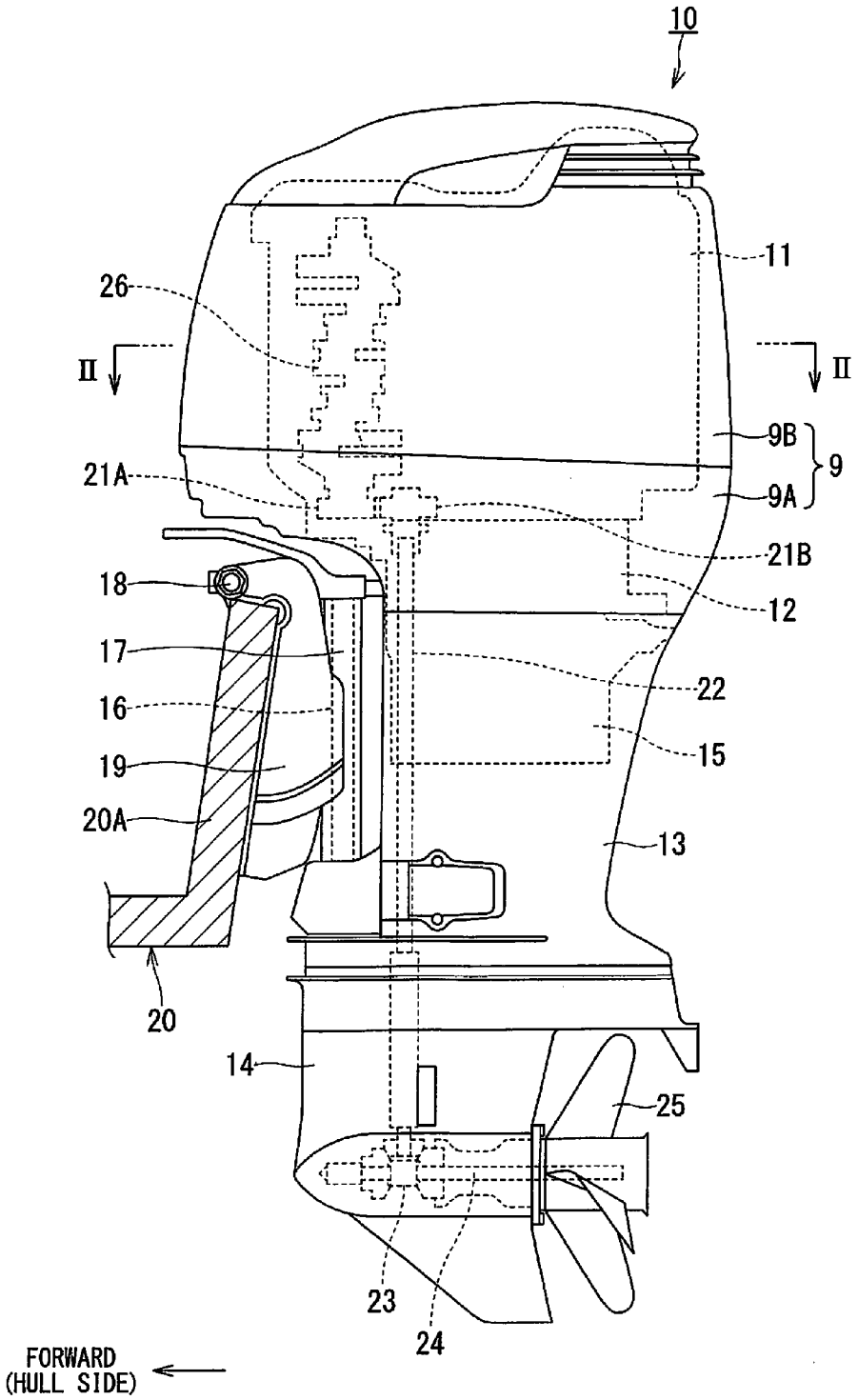
FIG. 1 is a left side view of an outboard motor to which one embodiment of an exhaust passage structure of an outboard motor of the present invention is applied.

With reference to FIG. 1 showing a left side view of an outboard motor 10 to which an embodiment of an exhaust passage structure thereof is applied.

The outboard motor 10 is equipped with an engine holder 12, on which an engine 11 is mounted. The engine 11 is a vertical-type engine in which a crankshaft 26 (described later) is mounted substantially vertically. A drive shaft housing 13 and a gear case 14 are assembled in sequence under the engine holder 12.

In FIG. 1, an oil pan 15 is located under the engine holder 12 in which a lubricating oil is reserved. A vertically dividable engine cover 9 includes a lower engine cover 9A and an upper engine cover 9B so as to cover the engine 11 and engine holder 12.

The outboard motor 10 is supported pivotally in a horizontal direction by means of a pilot shaft 16 pivotally supported on a swivel bracket 17. The swivel bracket 17 is supported on a swivel shaft 18 pivotally in a vertical direction with respect to a clamp bracket 19, which is attached to a stern (transom) 20A of a hull 20. Consequently, the outboard motor 10 is mounted on the hull 20 swingably in a horizontal direction (steering direction) and vertical direction (trim and tilt direction).

A driving force generated on the crankshaft 26 of the engine 11 is transmitted through reduction gears 21A and 21B to a drive shaft 22 disposed so as to extend substantially vertically in the drive shaft housing 13 and gear case 14 and is then transmitted through a shift mechanism 23 and propeller shaft 24 disposed in the gear case 14 to a propeller 25, thereby turning the propeller 25 in a forward or reverse direction. According to such arrangement, the outboard motor 10 causes the hull 20 to move forward or backward.

Figure 2:
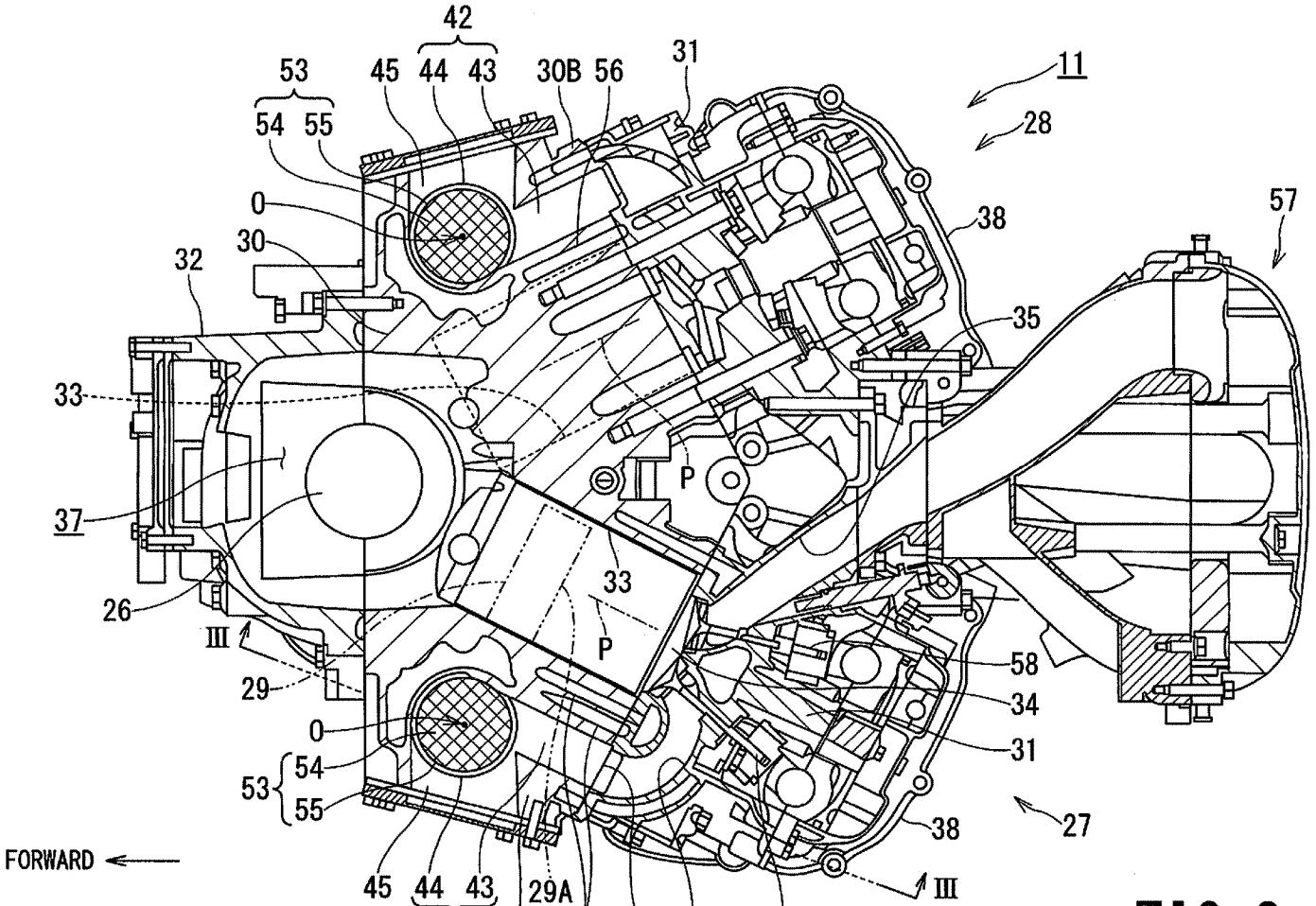
FIG. 2 is a sectional view taken along the line II-II in FIG. 1.

As shown in FIGS. 1 and 2, the engine 11 is a four-stroke V-type engine which includes the crankshaft 26 extending in a vertical direction, a left bank 27 extending diagonally left rearward, and a right bank 28 extending diagonally right rearward. In the four-stroke V-type engine, the left bank 27 is composed of a cylinder head 31 and a cylinder head cover 38 placed in sequence behind a left bank portion 30A of a cylinder block 30, and the right bank 28 is composed of a cylinder head 31 and a cylinder head cover 38 placed in sequence behind a right bank portion 30B of the cylinder block 30. Further, a crankcase 32 is placed in front of the cylinder block 30.

As shown in FIG. 2, cylinders 33 are formed in a horizontal direction inside the left bank portion 30A of the cylinder block 30, extending diagonally left rearward. Cylinders 33 are also formed in a horizontal direction inside the right bank portion 30B of the cylinder block 30, extending diagonally right rearward. Pistons 29 are reciprocally located in the cylinders 33 and coupled to the crankshaft 26 via connecting rods, not shown.

Along cylinder axes P of the cylinders 33 in the left bank portion 30A and right bank portion 30B of the cylinder block 30, the cylinder heads 31 are fixed, respectively, to the left bank portion 30A and right bank portion 30B so as to cover the cylinders 33, and at the same time, to form combustion chambers 34 in conjunction with respective cylinders 33 in the left bank portion 30A and right bank portion 30B.

Moreover, in the left bank portion 30A and right bank portion 30B of the cylinder block 30, intake ports 35 communicated with the combustion chambers 34 are formed in the cylinder heads 31 inwardly of the cylinder axes P of the cylinders 33 in a width direction of the outboard motor. Furthermore, in the left bank portion 30A and right bank portion 30B of the cylinder block 30, exhaust ports 36 communicated with the combustion chambers 34 are formed in the cylinder heads 31 outwardly of the cylinder axes P of the cylinders 33 in the width direction of the outboard motor.

The crankcase 32 is coupled to the cylinder block 30, thereby forming a crank chamber 37 in conjunction with the cylinder block 30, and the crankshaft 26 is housed in the crank chamber 37. Here, in each of the above-mentioned left bank 27 and right bank 28, plural cylinder assemblies 40 each equipped with a cylinder 33, a combustion chamber 34, an intake port 35, and an exhaust port 36 are arranged side by side in a vertical direction as shown in FIGS. 3 and 4.

More specifically, according to the present embodiment, three cylinder assemblies 40 are arranged side by side in the vertical direction in each of the right bank 28 and left bank 27, thus configuring the engine 11 into a V-type six-cylinder four-stroke engine.

Figure 3:
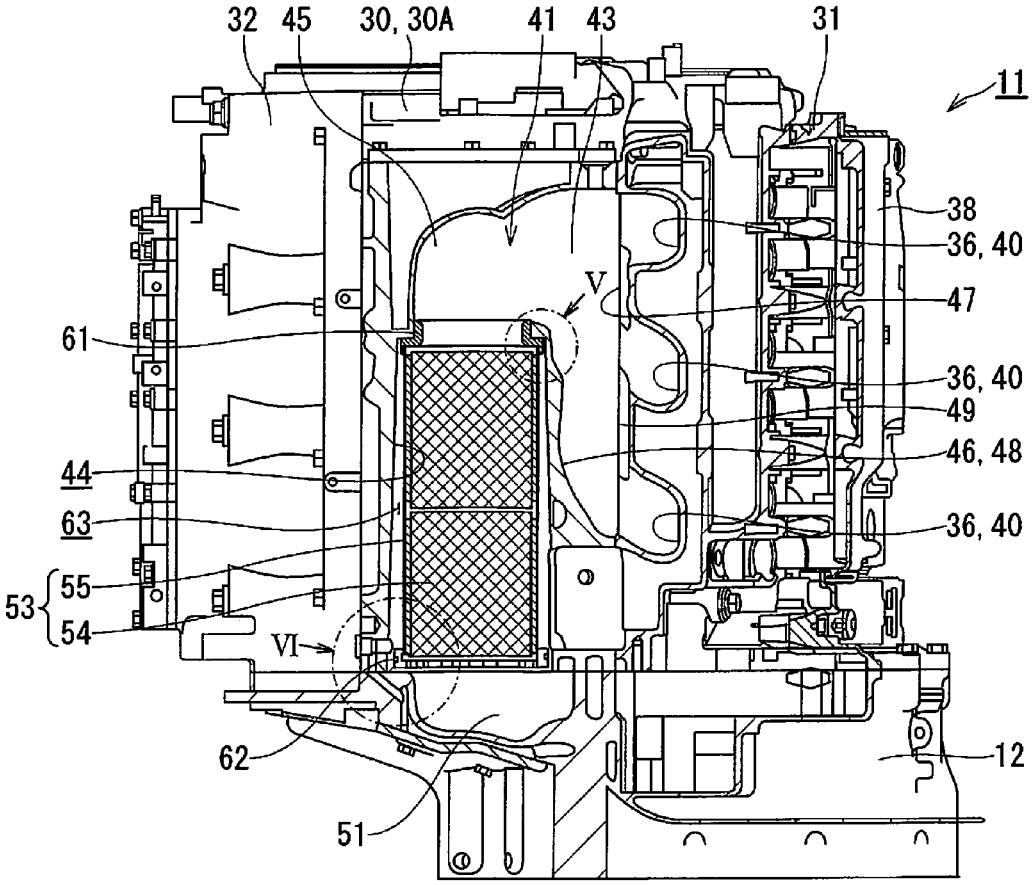
FIG. 3 is a sectional view taken along the line in FIG. 2.
Figure 4:
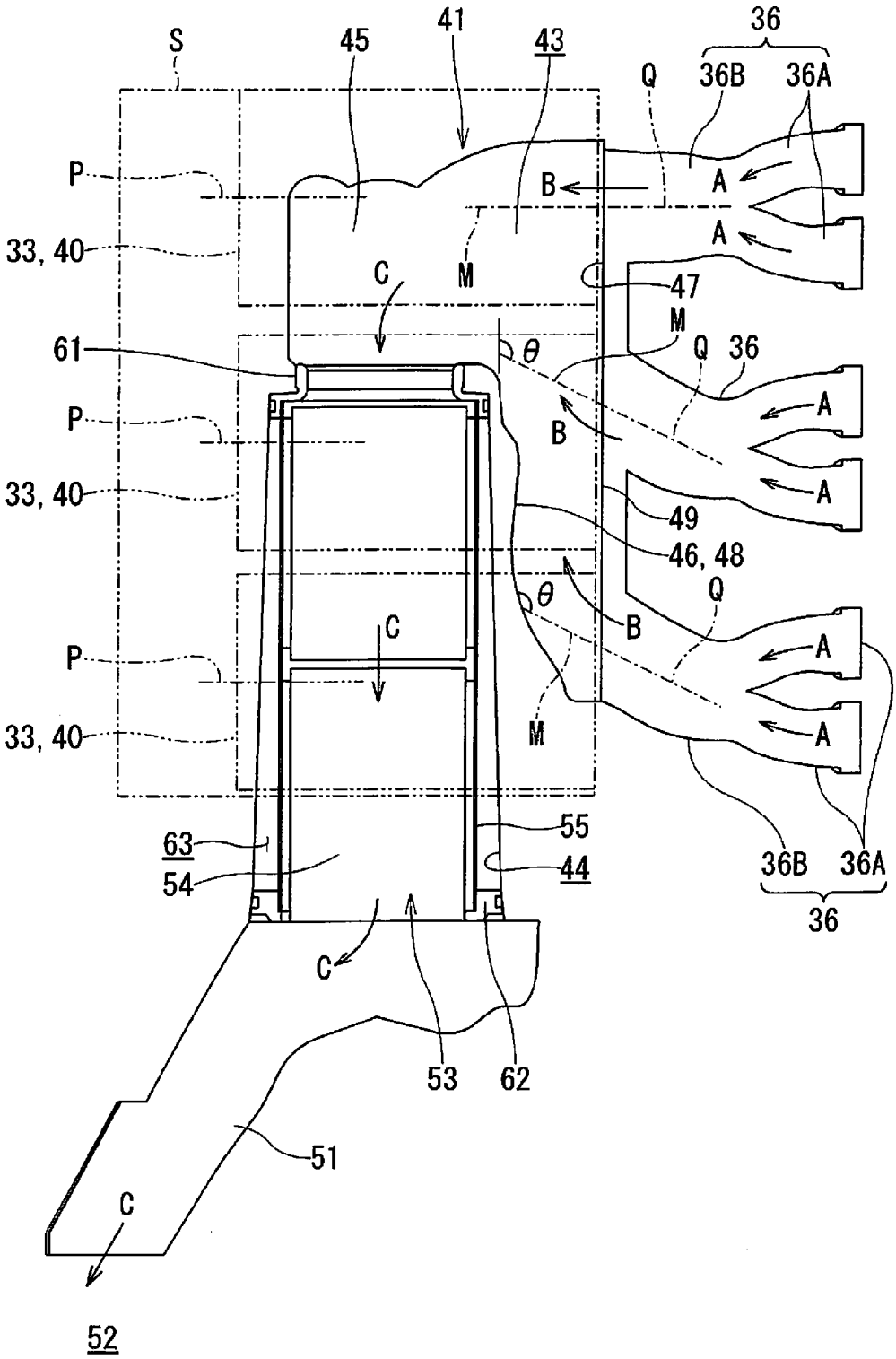
FIG. 4 is a schematic diagram illustrating an exhaust passage of an exhaust port shown in FIGS. 2 and 3.

As shown in FIGS. 2, 3, and 4, the respective exhaust ports 36 of the plural cylinder assemblies 40 in the left bank 27 are connected with a left exhaust passage 41 so as to lead exhaust gas from the exhaust port 36 out of the engine 11. The left exhaust passage 41 is formed integrally with the left bank portion 30A of the cylinder block 30.

The respective exhaust ports 36 of the plural cylinder assemblies 40 in the right bank 28 are connected with a right exhaust passage 42 so as to lead the exhaust gas from the exhaust port 36 out of the engine 11. The right exhaust passage 42 is formed integrally with the right bank portion 30B of the cylinder block 30. Each of the left exhaust passage 41 and right exhaust passage 42 includes an exhaust manifold 43 serving as a first exhaust passage portion and a catalyst storage space 44 serving as a second exhaust passage portion.

The exhaust manifold 43 is mounted on at least one of both the lateral sides, in the present embodiment, on both sides, of the cylinder block 30 in the width direction. That is, the exhaust manifold 43 of the left exhaust passage 41 is provided in lateral part of the cylinder block 30 on the left side in the width direction (left bank portion 30A), corresponding to the left bank 27, while the exhaust manifold 43 of the right exhaust passage 42 is provided in lateral part of the cylinder block 30 on the right side in the width direction (right bank portion 30B), corresponding to the right bank 28.

Furthermore, as shown in FIGS. 3 and 4, in particular, the exhaust manifolds 43 collect the exhaust gas discharged from the respective exhaust ports 36 of the plural cylinder assemblies 40.

In addition, a plurality of exhaust guiding portions 46 are provided for the respective exhaust manifolds 43 of the left exhaust passage 41 and right exhaust passage 42 so as to guide the exhaust gas discharged from the respective exhaust ports 36 of the plural cylinder assemblies 40 to connecting portions 45 between the exhaust manifolds 43 and catalyst storage spaces 44. Each of the exhaust guiding portions 46 is formed as a vertical plane opposed to a joint surface (parting plane) 47 between the cylinder block 30 and the cylinder head 31. The exhaust gas flowing in the exhaust port 36 as indicated by arrow "A" in FIG. 4 is guided upward by the exhaust guiding portion 46 as indicated by arrow "B" in the exhaust manifold 43, and the exhaust gas then reaches the connecting portion 45 between the exhaust manifold 43 and the catalyst storage space 44.

Each of the exhaust guiding portions 46 of the exhaust manifolds 43 is composed of a concave groove 48 formed integrally with the cylinder block 30 (left bank portion 30A and right bank portion 30B). Each of the concave grooves 48 has an opening 49 which opens to the side of the cylinder head 31 in a direction of the cylinder axis P of the cylinder 33. The opening 49 of the concave groove 48 is closed by the cylinder head 31 to thereby form the exhaust manifold 43.

Incidentally, since two exhaust valves 50 (FIG. 2) are installed in each combustion chamber 34, the exhaust port 36 of each of the plural cylinder assemblies 40, which is provided in the cylinder head 31, is formed into a Y-shape. That is, each exhaust port 36 is bifurcated into branch portions 36A, which are communicated with the combustion chamber 34, and a trunk portion 36B communicated with the branch portions 36A is connected to the exhaust manifold 43 generally forming a shape turned by approximately 180 degrees.

Furthermore, in the exhaust port 36 of each of the plural cylinder assemblies 40, an extension (extending line) M of a center line Q of the trunk portion 36B is provided in parallel to a plane S passing through the cylinder axes P of the cylinders 33 in the plural cylinder assemblies 40, and the extension M extends linearly or at an angle toward a connecting portion 45 between the exhaust manifold 43 and the catalyst storage space 44.

In the exhaust port 36 in which the extension M of the center line Q of the trunk portion 36B is set at an angle toward the connecting portion 45, the extension M forms an obtuse angle θ with the exhaust guiding portion 46, or an extension plane thereof, of the exhaust manifold 43. Therefore, the exhaust gas flowing into the exhaust manifold 43 through the exhaust ports 36 flows smoothly to the connecting portion 45 between the exhaust manifold 43 and the catalyst storage space 44.

As shown in FIG. 2, the catalyst storage space 44 in the left exhaust passage 41 is formed integrally on the left bank portion 30A of the cylinder block 30 and the catalyst storage space 44 in the right exhaust passage 42 is formed integrally on the right bank portion 30B of the cylinder block 30, both being, for example, substantially circular in passage section.

As shown in FIGS. 3 and 4, the catalyst storage spaces 44 are communicated with both the connecting portions 45 of the exhaust manifolds 43 and an exhaust passage 51 of the engine holder 12, thereby connecting exhaust manifolds 43 with an exhaust muffler chamber 52 in the drive shaft housing 13 installed outside the engine 11. Then, catalytic converters 53 having, for example, a circular shape in section for purifying the exhaust gas are installed and housed in the catalyst storage spaces 44.

Each catalytic converter 53 is configured such that a catalyst carrier 54 formed into, for example, a columnar shape and equipped with an exhaust purification function is housed in a catalyst tube 55, having a cylindrical shape, for example. When the catalyst carrier 54 comes into contact with exhaust gas, it chemically changes toxic substances such as carbon monoxide, hydrocarbon, nitrogen oxides, and the like contained in the exhaust gas into water, carbon dioxide, nitrogen or the like via oxidation-reduction reactions to thereby purify the exhaust gas.

Accordingly, the exhaust gas produced in the combustion chambers 34 of the plural cylinder assemblies 40 in the left bank 27 and right bank 28 of the engine 11 shown in FIG. 2, flows in the direction of the arrow "A" (FIG. 4) through the exhaust ports 36 of the cylinder assemblies 40 in the left bank 27 and right bank 28 and into the respective exhaust manifolds 43 of the left exhaust passage 41 and right exhaust passage 42.

As shown in FIGS. 3 and 4, the exhaust gas flowing into each exhaust manifold 43 ascends as indicated by the arrow "B" by being guided by the exhaust guiding portion 46, and then reaches the connecting portion 45 between the exhaust manifold 43 and the catalyst storage space 44. The exhaust gas flows downward in the connecting portion 45 as indicated by the arrow "C" by reversing its direction and flows into the catalytic converter 53 in the catalyst storage space 44 in order to be purified.

The exhaust gas purified by the catalytic converters 53 flows downward in the exhaust passage 51 of the engine holder 12 as indicated by the arrow "C" and flows into the exhaust muffler chamber 52 of the drive shaft housing 13, thereby being expanded and muffled therein. Subsequently, the exhaust gas flows in an exhaust passage, not shown, formed around the propeller shaft 24 in the gear case 14 shown in FIG. 1 and is discharged into water from a center of the propeller 25.

As shown in FIG. 2, cooling water passages 56 are formed around the cylinders 33 in the left bank portion 30A and the right bank portion 30B of the cylinder block 30. However, in a case where the circumferential portions of the cylinders 33 are located closer to the side of the crankshaft 26 than to positions of top faces 29A of the pistons 29 located at bottom dead center during reciprocation of the pistons 29 in the cylinders 33, these circumferential portions have relatively low temperatures, and thus, the cooling water passage 56 is not provided around the circumferences of the cylinders 33 on the side of the crankshaft 26.

Because of the reason mentioned above, the center locations O of the passage sections in the catalyst storage spaces 44 of the left exhaust passage 41 and the right exhaust passage 42 are positioned closer to the side of the crankshaft 26 than to the positions of the top faces 29A of the pistons 29 located at the bottom dead center in the cylinders 33, thus the catalyst storage spaces 44 being located close to the cylinders 33.

Further, in FIG. 2, reference numeral 57 denotes an intake manifold connected to the intake ports 35 of the engine 11 so as to lead fuel-air mixture to the combustion chambers 34 through the intake ports 35 when intake valves 58 are opened.

Figure 5:
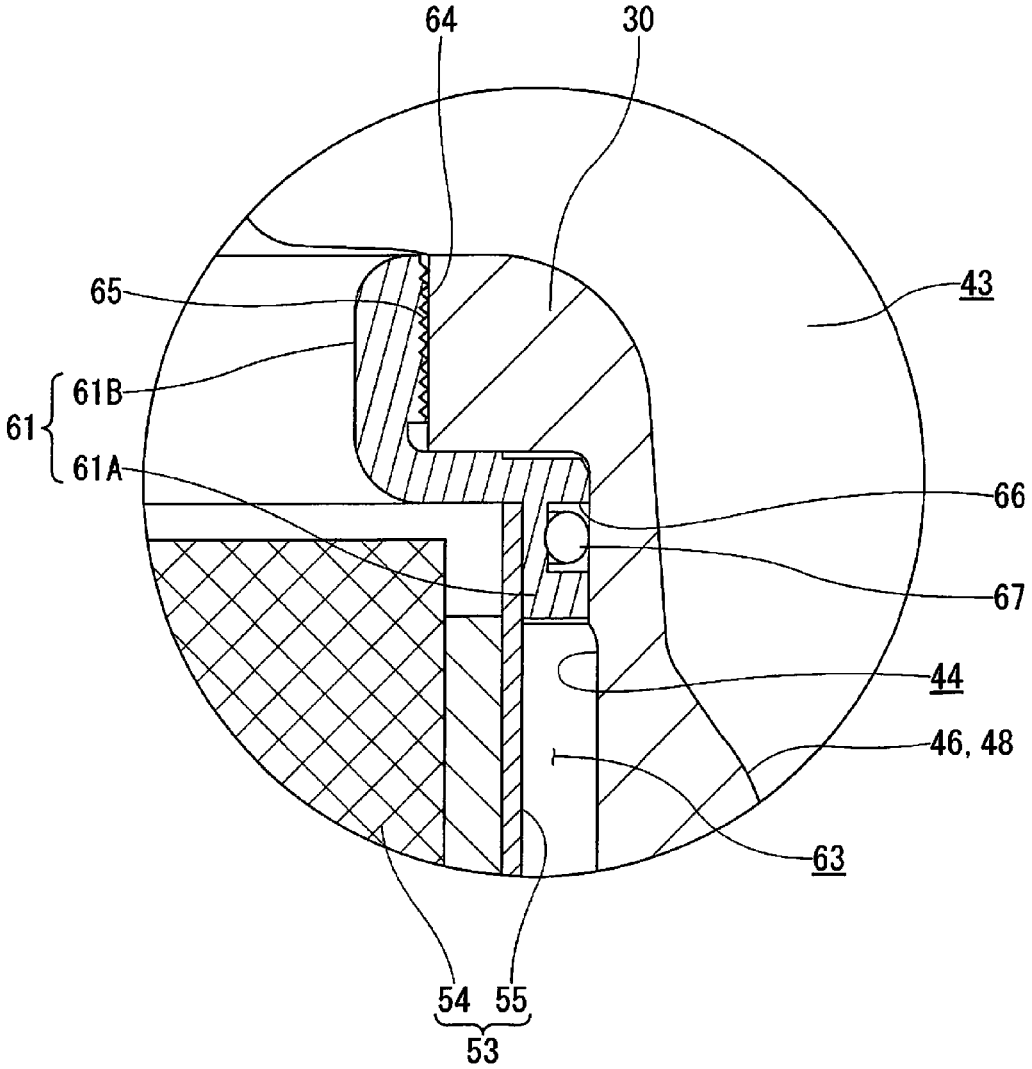
FIG. 5 is an enlarged sectional view showing a V-portion in FIG. 3.
Figure 6:
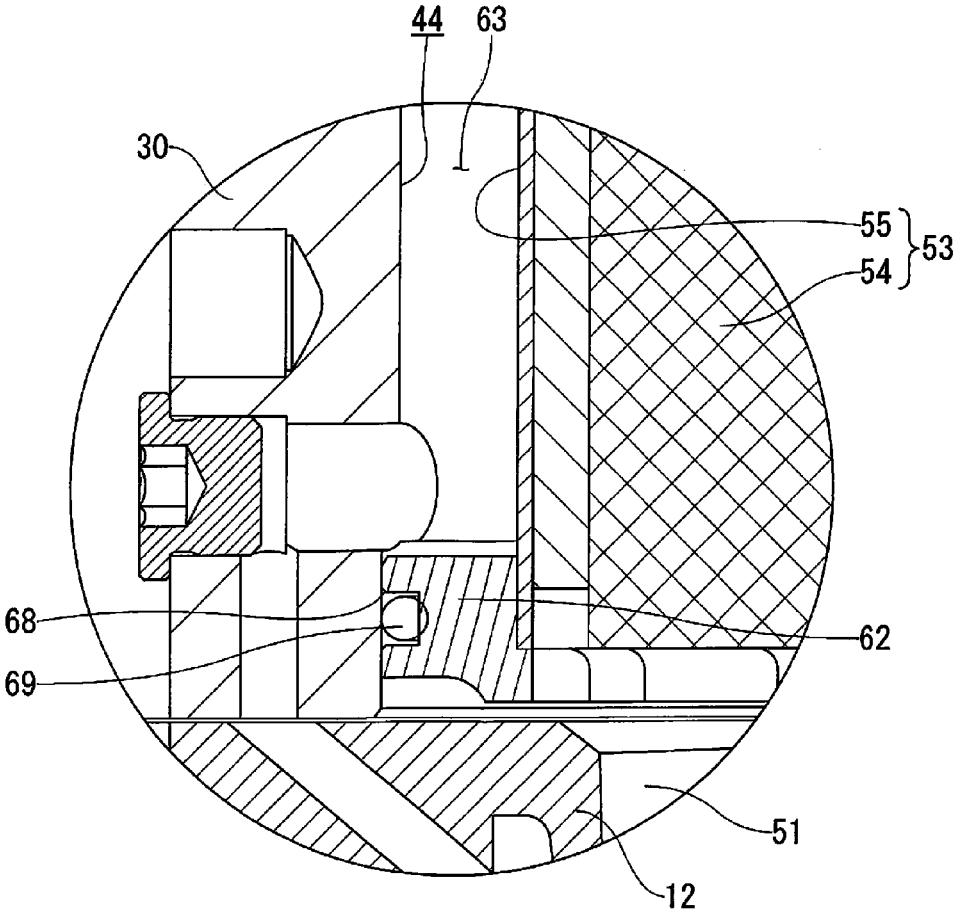
FIG. 6 is an enlarged sectional view showing a VI-portion in FIG. 3.

As shown in FIGS. 3, 5, and 6, an upper holder (i.e., upper supporting member) 61 and a lower holder (i.e., lower supporting member) 62 are firmly fixed, respectively, to an upper-side end portion and lower-side end portion of the catalyst tube 55 of each catalytic converter 53 by welding or the like. Since the upper holder 61 and lower holder 62 come into contact with an inner surface of the catalyst storage space 44, a gap 63 is formed between the catalyst tube 55 of the catalytic converter 53 and the inner surface of the catalyst storage space 44.

As shown in FIGS. 3 and 5, the upper holder 61 has a large-diameter portion 61A and a small-diameter portion 61B. The catalyst tube 55 is firmly fixed to an inner circumferential surface of the large-diameter portion 61A and an external thread portion 64 is formed on an outer circumferential surface of the small-diameter portion 61B. The catalytic converter 53 is inserted from the lower side of the catalyst storage space 44, and when the external thread portion 64 of the upper holder 61 of the catalytic converter 53 is screwed into an internal thread portion 65 formed in an upper end portion of the catalyst storage space 44, the catalytic converter 53 is fastened to the catalyst storage space 44 by means of screw.

A ring groove 66 is formed in an outer circumferential surface of the large-diameter portion 61A of the upper holder 61, and an O-ring 67, serving as an annular sealing member, is fitted in the ring groove 66. The O-ring 67 seals the upper-side end portion of the catalytic converter 53 and the inner surface of the catalyst storage space 44 in a radial direction.

As shown in FIGS. 5 and 6, the lower holder 62 has an annular shape, and the catalyst tube 55 of the catalytic converter 53 is firmly fixed to an inner circumferential surface of the lower holder 62. A ring groove 68 is formed in an outer circumferential surface of the lower holder 62, and an O-ring 69, serving as an annular sealing member, is fitted in the ring groove 68. The O-ring 69 seals the lower-side end portion of the catalytic converter 53 and the inner surface of the catalyst storage space 44 in a radial direction.

As shown in FIGS. 3, 5, and 6, the respective O-rings 67 and 69 on the upper holder 61 and lower holder 62 of the catalytic converter 53 seal the upper and lower portions of the gap 63, respectively, thereby hermetically sealing the gap 63. Therefore, the gap 63 in the present embodiment is formed as a cooling water passage through which cooling water flows, and the catalytic converter 53 is cooled directly by the cooling water flowing through the gap 63.

Furthermore, the catalytic converter 53 is configured such that at least one end in an axial direction, (i.e., lower-side end portion to which the lower holder 62 is firmly fixed in the present embodiment), is fitted in the catalyst storage space 44 by the lower holder 62 including the O-ring 69 in such a way as to permit axial expansion and contraction of the catalytic converter 53 due to, for example, thermal expansion.

In this regard, it is to be note that the catalytic converter 53 may be configured such that the lower holder in the lower-side end portion will be screw-fastened to the catalyst storage space 44, with the upper holder in the upper-side end portion being fitted in the catalyst storage space 44 in such a way as to permit axial expansion and contraction of the catalytic converter 53. Furthermore, the catalytic converter 53 may be configured such that both upper holder in the upper-side end portion and lower holder in the lower-side end portion will be fitted in the catalyst storage space 44, by being supported in the catalyst storage space 44 by a stay or the like, in such a way as to permit axial expansion and contraction of the catalytic converter 53.

According to the present embodiment described above, the following advantageous effects and/or functions (1) to (5) can be achieved.

(1) As shown in FIGS. 3 and 4, since the exhaust manifolds 43 are installed in the cylinder block 30 so as to collect exhaust gas from the respective exhaust ports 36 of the plural cylinder assemblies 40, the exhaust ports 36 provided in the cylinder head 31 can be increased in length. Furthermore, since the exhaust guiding portions 46 of the exhaust manifolds 43 guide the exhaust gas from the exhaust ports 36 to the connecting portions 45 between the exhaust manifolds 43 and catalyst storage spaces 44, the flow resistance against the exhaust gas flowing from the exhaust ports 36 through the exhaust manifolds 43 to the catalyst storage spaces 44 can be reduced, making it possible to prevent power loss of the engine 11.

(2) As shown in FIG. 2, since the exhaust manifolds 43 for collecting the exhaust gas from the exhaust ports 36 are formed in the cylinder block 30 by being connected to the exhaust ports 36 formed in the cylinder heads 31, the existence of the exhaust manifolds 43 eliminates the need to increase a dimension of the engine 11 in the width direction, thereby making it possible to downsize the engine 11. Accordingly, in a case where the hull 20 is equipped with a plurality of the outboard motors 10 arranged side by side, it is possible to maintain good maneuverability of the hull 20 without increasing installation spacing (interval) among the outboard motors 10.

(3) As shown in FIGS. 3 and 4, the extension M of the center line Q on the trunk portion 36B of each exhaust port 36 formed in the cylinder head 31 extends linearly or at an angle toward the connecting portion 45 between the exhaust manifold 43 and the catalyst storage space 44. Accordingly, even when the extension M of the center line Q on the trunk portion 36B of the exhaust port 36 is set at an angle as described above, the extension M forms an obtuse angle θ with the exhaust guiding portion 46, or an extension plane thereof, of the exhaust manifold 43. Thus, the exhaust gas flowing into the exhaust manifold 43 from each exhaust port 36 can be made to flow smoothly in the exhaust manifold 43, and the pressure loss of the exhaust gas can be hence reduced, and as a result, it makes possible to avoid power loss of the engine 11.

(4) As shown in FIGS. 2 and 3, each of the exhaust guiding portion 46 of the exhaust manifold 43 is composed of a concave groove 48 formed integrally with the cylinder block 30 (left bank portion 30A and right bank portion 30B) and each of the concave grooves 48 has the opening 49 which opens to the side of the cylinder head 31 in the direction of the cylinder axes P of the cylinders 33. Such arrangement simplifies a die structure for the cylinder block 30 and improves casting performance, making it possible to reduce cost and improve the parts making accuracy of the cylinder block 30.

(5) As shown in FIG. 2, the center locations O of passage sections in the catalyst storage spaces 44 of the left exhaust passage 41 and the right exhaust passage 42 are positioned closer to the side of the crankshaft 26 than to the positions of top faces 29A of the pistons 29 located at bottom dead center in the cylinders 33. Therefore, the catalyst storage spaces 44 can be located close to the cylinders 33, thereby making it possible to reduce the dimension of the engine 11 in the width direction and hence to downsize the engine 11.

It is further to be noted that although the embodiment of the present invention described above is presented only by way of example, and not intended to limit the scope of the invention, and the embodiment can be implemented in various other forms, and various omissions, replacements, and modifications may be made without departing from the spirit of the present invention.

For example, in the present embodiment, although a case in which the engine 11 is a V-six four-stroke type has been described, the engine 11 may be an in-line multi-cylinder four-stroke type. In the in-line multi-cylinder four-stroke engine, an exhaust passage (exhaust manifold and catalyst storage space) will be installed on one lateral side of the cylinder block in the width direction.

What is claimed is:

1. An exhaust passage structure for an outboard motor equipped with a four-stroke engine, in which the four-stroke engine includes a cylinder block in which a cylinder is formed so as to extend in a horizontal direction; a cylinder head fixed to the cylinder block so as to cover the cylinder and to form a combustion chamber in conjunction with the cylinder, the cylinder head being provided with an exhaust port communicated with the combustion chamber to discharge exhaust gas; and a crankcase which houses a crankshaft extending in a vertical direction, the exhaust passage structure comprising:

a plurality of cylinder assemblies each equipped with the cylinder, the combustion chamber, and the exhaust port are arranged side by side in the vertical direction in the cylinder block and under the cylinder head;

an exhaust passage connected to the respective exhaust ports of the plurality of cylinders so as to lead the exhaust gas out of the engine includes a first exhaust passage portion and a second exhaust passage portion, in which the first exhaust passage portion is provided on at least one lateral side of the cylinder block in a width direction and configured to collect the exhaust gas discharged from the respective exhaust ports of the plurality of cylinder assemblies, while the second exhaust passage portion connects the first exhaust passage portion with an exhaust muffler chamber installed outside the engine; and an exhaust guiding portion is provided so as to oppose to a joint surface between the cylinder block and the cylinder head in a manner to be located in the first exhaust passage portion to guide the exhaust gas discharged from the exhaust ports to a connecting portion between the first exhaust passage portion and the second exhaust passage portion, wherein the exhaust guiding portion of the first exhaust passage portion is made up of a concave groove formed integrally with the cylinder block and configured to open to a side of the cylinder head so that the cylinder head closes the opening of the concave groove to thereby form the first exhaust passage portion.

2. The exhaust passage structure for an outboard motor according to claim 1, wherein the second exhaust passage portion is formed integrally with the cylinder block, a catalytic converter configured to purify the exhaust gas is installed in the second exhaust passage portion, and a center location of a passage section is positioned closer, in a forward and backward direction of the outboard motor, to a side of the crankshaft than to positions of top faces of pistons for the cylinder assembly located at bottom dead center in the cylinders.

3. The exhaust passage structure for an outboard motor according to claim 1, wherein the four-stroke engine is a four-stroke V-type engine in which a cylinder block and a cylinder head have a left bank and a right bank, the left bank including cylinders and extending diagonally left rearward and the right bank including cylinders and extending diagonally right rearward, and a first exhaust passage portion of an exhaust passage is provided on both lateral portions of the cylinder block in the width direction in a manner corresponding to the left bank and the right bank.

* * * * *